US005316696A

United States Patent [19]

Tury

[11] Patent Number: 5,316,696

[45] Date of Patent: May 31, 1994

[54] COMPOSITION

[75] Inventor: Bernard Tury, Manchester, England

[73] Assignee: Imperial Chemical Industries PLC, London

[21] Appl. No.: 692,862

[22] Filed: Apr. 29, 1991

[30] Foreign Application Priority Data

Apr. 30, 1990 [GB] United Kingdom ..... 9009625

[51] Int. Cl.[5] ..... C10M 133/22; C23F 11/14

[52] U.S. Cl. ..... 252/394; 252/515 R; 252/56 R; 252/52 A; 252/396; 422/16

[58] Field of Search ..... 252/394, 396, 52 A, 252/56 R, 51.5 R; 394/52 A; 396/56 R, 51.5 R

[56] References Cited

U.S. PATENT DOCUMENTS 4,298,488 11/1981 Tanizaki et al. ..... 252/52 A
4,317,740 3/1982 Eisenhard ..... 252/52 A
4,689,166 8/1987 Dohner ..... 252/52 A
4,784,784 11/1988 Dohner ..... 252/52 A

FOREIGN PATENT DOCUMENTS 0125025 4/1984 European Pat. Off. .
1365291 8/1974 United Kingdom .

OTHER PUBLICATIONS

Derwent Publications Ltd., London, GB No. 81-74 846 (JP-A-56,109,261 Aug. 29, 1981).
Derwent Publications Ltd., London, GB No. 78-75 466 (JP-A-53,105,534 Sep. 13, 1978).

*Primary Examiner*—Robert L. Stoll
*Assistant Examiner*—Valerie Fee
*Attorney, Agent, or Firm*—Paul L. Sharer

[57] ABSTRACT

A composition comprises a poly(oxyalkylene)glycol derivative and a long chain anhydride and optionally a hydroxy-oxime. The long chain anhydride can be an alk(en)yl succinic anhydride in which the alk(en)yl group contains at least six carbon atoms. The optional hydroxy-oxime can be an alkyl-substituted benzaldoxime. The composition has improved corrosion resistance and can provide protection of a metal even in the form of a thin film.

15 Claims, No Drawings

COMPOSITION

The present invention relates to a new composition and is particularly concerned with a composition which is effective to improve the resistance of a metal to oxidative, and/or other, deterioration.

Metal surfaces which are exposed to weather are particularly vulnerable to oxidative deterioration and require protection. Oxidative deterioration of a metal may be reduced by contacting the metal with a suitable composition particularly a composition which has corrosion inhibiting properties.

Compositions which can be used to reduce corrosion can be based on lubricants such as oils and greases. Such compositions contain at least one additive which is effective in retarding corrosion of a metal in contact with the lubricant. A wide range of materials have been proposed as additives to provide corrosion inhibition. Some of these materials contain lead or hexavalent chromium but there is a growing awareness of the toxicity of lead and hexavalent chromium and this has already resulted in some replacement of these materials by alternative materials. Slightly soluble metal salts of organic acids have been used as corrosion inhibiting additives in aqueous reservoir systems. Materials which have been proposed as corrosion inhibitors in metal coating compositions such as paint fomulations, particularly for ferrous metals, include magnesium azelate (GB 1555468), zinc and lead 5-nitroisophthalates (GB 1531093), zinc cyanurate (U.S. Pat. No. 4,329,381) and zinc and lead N-phenylglycinate (DE 3306064). Barium salts of hydroxy 4 carboxylic acids such as salicylic acid have also been proposed (U.S. Pat. No. 4,304,707). The salts of a divalent metal and a hydroxycarboxylic acid containing a fused ring system have also been disclosed as having corrosion inhibiting properties (EP 289155). Many of the foregoing metal salts are indicated to be very effective, and also to be useful in improving the performance of zinc phosphate when present at low levels. However, many of these materials have been mainly used in paint formulations.

In addition to the various metal salts which can be used as corrosion inhibitors, there have also been proposals to use organic compounds as corrosion inhibitors. Organic compounds proposed for use as corrosion inhibitors include oximes such as benzaldoxime (GB 1365291), salicylaldoxime, 2-hydroxy-5-alkylbenzaldoximes in which the alkyl group contains 7 to 13 carbon atoms (EP 125025), bis-oximes (EP 178850) and hydroxy oxime metal complexes (EP 206716), di- and tri-hydroxybenzene derivatives (GB 676632, GB 1045118, U.S. Pat. No. 2,429,905 and EP 239288), alkenyl or alkyl succinic acid or anhydride and derivatives thereof (GB 1055337 and U.S. Pat. No. 4,326,987) and polyesters and functionally terminated derivatives thereof (U.S. Pat. No. 3,415,766, U.S. Pat. No. 3,574,566 and EP 277711). Other corrosion inhibitors include, inter alia, organic acids and the esters thereof, primary, secondary and tertiary aliphatic amines and the amine and alkanolamine salts of organic acids, phosphorus-containing compounds and sulphur-containing compounds.

Various of the materials disclosed as providing corrosion inhibiting properties can be used in organic media, particularly oils and greases. However, not all materials which provide corrosion inhibiting properties can be used in oils or greases. Furthermore, we have found that different oils and greases respond in a different manner to the presence of a particular corrosion inhibiting additive. In particular we have found that a wide range of corrosion inhibiting additives have little effect when used in poly(oxyalkylene) glycol derivatives such as those used as lubricants. We have now obtained a composition based on a poly(oxyalkylene) glycol derivative and which has surprisingly useful corrosion inhibiting properties.

According to the present invention there is provided a composition which comprises a liquid, poly(oxyalkylene) glycol derivative and a long chain carboxylic acid anhydride.

The liquid poly(oxyalkylene) glycol derivative is particularly one which is suitable for use as a lubricant and is typically a polymeric material containing alkylene oxide repeating units. More specifically, the liquid poly(oxyalkylene) glycol derivative contains ethylene oxide or propylene oxide repeating units, or may contain both ethylene oxide and propylene oxide repeating units.

The poly(oxyalkylene) glycol derivative is typically a product obtained by the alkoxylation of a mono-, di- or polyhydroxy compound, particularly an aliphatic hydroxy compound such as methanol, ethanol, propanol, butanol or higher alkanol, a diol such as ethylene glycol or a polyol such as glycerol or pentaerythritol. In such compounds there are one or more poly(oxyalkylene) glycol chains, one end of which is linked to the residue of the hydroxy compound through an ether linkage.

The poly(oxyalkylene) glycol derivative may be soluble or insoluble in water. Poly(oxyalkylene) glycol derivatives which are soluble in water are typically those in which the (oxyalkylene) groups are solely or predominantly (that is at least 5OZ by weight) oxyethylene groups. Poly(oxyalkylene) glycol derivatives which are insoluble in water are typically those in which the (oxyalkylene) groups are solely or predominantly oxypropylene groups.

The poly(oxyalkylene) glycol derivative is a material which is in the liquid state, at least at the temperature of use, and preferably at a temperature of 25 C. The poly(oxyalkylene) glycol derivative may be suitable for use as a lubricant, for example as a gear oil or as the basis of a grease. Alternatively, if the poly(oxyalkylene) glycol derivative is a high viscosity, water-soluble material, it may be used in hydraulic fluids. The molecular weight of the poly(oxyalkylene) glycol derivative may be such that the material has a viscosity, measured at 40° C. using the procedure of ASTM Test Method D445, which is in the range of from 5 up to 500,000 cSt, and more preferably in the range from 10 up to 250,000 cSt.

If the poly(oxyalkylene) glycol derivative is a water-insoluble material based solely or predominantly on oxypropylene repeat units, such a material typically has a viscosity in the range from 10 up to 1200 cSt.

If the poly(oxyalkylene) glycol derivative is a water-soluble material, based solely or predominantly on oxyethylene repeat units, such a material may have a viscosity in the range from 25 up to 250,000 cSt. If such a poly(oxyalkylene) glycol derivative is one which is suitable for use in oils or greases, it preferably has a viscosity in the range from 25 up to 1500 cSt. Water-soluble materials of high viscosity, that is having a viscosity in the range from 1500 up to 250,000 cSt and in general with a viscosity of at least 15000 cSt, are typically used in hydraulic fluids.

Suitable poly(oxyalkylene) glycol derivatives include, for example, water-insoluble materials which have a viscosity of at least 200 cSt up to 500 cSt. Suitable water-soluble materials have a viscosity of at least 100 cSt and preferably the viscosity does not exceed 750 cSt. Suitable poly(oxyalkylene) glycol derivatives are available as 'EMKAROX'. (Registered Trade Mark) polyalkylene glycols from Imperial Chemical Industries PLC.

The long chain carboxylic acid anhydride (hereafter for convenience simply "anhydride") is preferably an anhydride of a dicarboxylic acid, particularly an $\alpha,\beta$-dicarboxylic acid. The long chain which is present in the anhydride is a linear or branched, saturated or unsaturated aliphatic hydrocarbyl radical and in particular is such a hydrocarbyl radical which contains at least six carbon atoms.

As a preferred aspect of the present invention, the long chain carboxylic acid anhydride is a compound of the general formula (I).

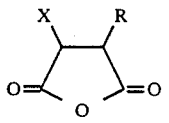

wherein:

R is a long chain hydrocarbyl radical which is linear or branched, saturated br unsaturated;

X is hydrogen or an alkyl, aryl, alkoxy or aralkyl group;

or

R and/pr X are linked to another cyclic anhydride group which may be the same or different; or R and X together form a ring system which is substituted with at least one long chain hydrocarbyl radical.

The anhydride is typically one in which X is hydrogen and R is a long chain hydrocarbyl radical. By long chain hydrocarbyl radical is meant a hydrocarbon chain which contains at least six carbon atoms. The group R is especially a hydrocarbon chain which has a molecular weight of at least 100, whereby the group R typically contains at least 8 carbon atoms. The group R can be a linear or branched group such as nonyl, decyl, decenyll dodecyl, dodecenyl, tetradecyl, tetradecenyl, hexadecyl, octadecyl, octadecenyl and the like and may be a mixture of different groups, for example a mixture of dodecenyl and tetradecenyl groups.

The group R can be derived from a polymeric material, for example an anhydride in which R is derived from an is obutylene polymer. Such anhydrides include succinic anhydrides (X is hydrogen in above formula) where the group R is an isobutylene polymer of molecular weight from about 200 to 8000, especially from 600 to 6000. It is particularly preferred in such derivatives that R is derived from an isobutylene polymer made from butene-1, butene-2 and isobutene. Materials of this type, which contain predominantly isobutylene units, are readily available and are referred to as polyisobutylene succinic anhydride, or PIBSA. Materials of this type are conveniently prepared by reacting the corresponding isobutylene polymer or a chlorination product thereof, with maleic anhydride.

If R and X together form a ring system, the resulting anhydride may, for example, be along chain substituted derivative of phthalic anhydride in which the long chain substitutent is as defined for the group R.

The corresponding acids derived from the anhydrides may be present in the long chain carboxylic acid anhydride and consequently the compositions in accordance with the present invention may also include these acids, which typically result from hydrolysis of the anhydride.

In addition to the anhydride, the composition of the present invention conveniently contains a further component which is a hydroxy-oxime.

The hydroxy-oxime which is the optional further component of the composition in accordance with the present invention contains the moiety

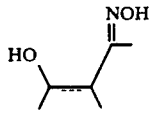

More specifically, the hydroxy-oxime is a compound of the general formula:

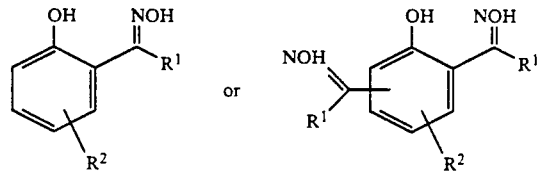

where $R^1$ is a hydrogen atom or a substituted or unsubstituted hydrocarbon group; and $R^2$ is a substituted or unsubstituted hydrocarbon group in which the hydrocarbon group contains from 5 to 22 carbon atoms.

The group $R^1$ is preferably a hydrogen atom but may be an alkyl, aryl or benzyl group, for example a methyl group. In the bis-oxime compound, the second oxime group is preferably in the 6-position and particularly preferred compounds of this type are the 2,6-bis(oximinomethyl)-4-alkylphenols such as 2,6-bis(oximinomethyl)-4-nonylphenol.

The group $R^2$ is preferably an alkyl group containing from 5 to 14 carbon atoms. The preferred mono-oximes are 2-hydroxy-5-alkylbenzaldoximes. The group $R^2$ may be a linear or branched, saturated or unsaturated group. Compounds in which $R^2$ is a branched alkyl group are particularly preferred. Suitable compounds of this type include 2-hydroxy-5-nonylbenzaldoxime and 2-hydroxy-5-dodecylbenzaldoxime. Compounds in which the group $R^1$ is a hydrocarbon group are the ketoximes such as, for example 2-hydroxy-5-nonylacetophenone oxime.

The weight ratio of the anhydride or mixture thereof with the corresponding acid, to the optional hydroxy-oxime may be between 99:1 to 1:99 but will generally be from 10:1 to 1:10, particularly from 5fl to 1:5. However, the preferred proportions will be dependent on the particular compounds present in the mixture.

The composition of the invention may also include other materials, particularly materials which are known additives to lubricant compositions and particularly materials which can be used in poly(oxyalkylene) glycol lubricants. Such other additives include corrosion inhibiting materials such as, for example, petroleum sulphonates, aryl sulphonates and the metal salts thereof and other corrosion inhibiting materials of the types disclosed previously herein. Other additives which may be added to improve the properties of the composition include anti-oxidants, metal passivators, viscosity-index improvers, pour-point depressants, dispersants/detergents, anti-wear additives and extreme pressure additives. A wide range of materials suitable for such purposes are known. Anti-oxidants are typically phenols which may be monophenols or contain more than one phenolic group as in thio-bisphenols, alkylidene-bisphenols and the esters of β-(3,5-di-tert-butyl-4-hydroxyphenyl)-propionic acid with mono- or polyhydric alcohols such as octadecanol and pentaerythritol. Alternatively an amine antioxidant may be present. Metal passivators include triazoles and thiazoles and derivatives thereof such as substituted benzotriazoles and substituted 2-mercapto-benzothiazoles. Anti-wear additives include sulphur-and/or phosphorus-and/or halogen-containing compounds. The proportions of such other additives will be those known to the skilled worker in the lubricant field.

The other materials may be present in the composition in a substantial proportion of up to several times, for example up to ten times, by weight of the anhydride or the mixture of the anhydride, acid and/or the optional hydroxy-oxime. Id general no particular advantage is achieved by using a large excess of the other materials and preferably the proportion of the other materials do not exceed twice the weight of the mixture and conveniently the other materials are present in essentially an equal proportion by weight relative to the weight of anhydride or the mixture thereof with acid and/or the optional hydroxy-oxime.

As noted previously herein, the compositions of the present invention provide improved corrosion inhibition. Certain compositions of the present invention also provide enhanced anti-wear properties and improved anti-oxidation properties.

Thus, as a further aspect of the present invention, there is provided a process which comprises contacting a metal with a composition in accordance with the present invention.

The process of the present invention is especially suitable for the corrosion inhibition of iron, zinc, copper, tin and aluminium and in particular mild steel and the zinc surface of galvanished steel.

The metal may be treated with the composition in any suitable manner and we have found it is useful to contact the metal with the composition and then to allow the composition to drain from the metal leaving a thin film, for example of thickness not more than 100 micrometres, of the composition on the surface of the metal to be protected. Alternatively, if it is being used as a lubricant such as a gear box oil, the composition is used in the conventional manner as a lubricant and at the same time provides the required protection against corrosion.

The proportion of the anhydride, or the mixture of anhydride and acid and/or hydroxy-oxime, which is present in the composition is dependent on the manner in which the composition is to be used and will be greater under conditions in which a more severe corrosive environment is to be expected. In general the composition will contain at least 0.01% by weight, relative to the total composition of poly(oxyalkylene) glycol derivative anhydride, any corresponding acid and the optional hydroxy-oxime, of the anhydride or mixture of anhydride, corresponding acid and/or hydroxy-oxime and preferably will contain at least 0.1% by weight of the anhydride or mixture of anhydride, acid and/or hydroxy-oxime. For transport or storage, the composition can contain any suitable level of the anhydride, or mixture of anhydride, acid and/or hydroxy-oxime, for example up to 30% by weight or even higher. However, in use such high levels are generally not necessary in order to achieve a suitable level of protection against corrosion. Thus, the composition of the present invention typically does not contain more than 5% by weight of the anhydride or mixture of anhydride, acid and/or hydroxy-oxime and satisfactory corrosion inhibition has been obtained with compositions containing not more than 2% by weight of the anhydride or mixture of anhydride, acid and/or hydroxy-oxime.

The composition of the present invention may be used to provide temporary protection whilst a metal article is being transferred from one site to another. At the present time many metal articles are coated with a soft coating such as a grease or wax composition to provide protection whilst the metal article is being transferred. However, it is necessary to remove the soft coating composition from the metal surface prior to use. The composition of the present invention is more readily applied to the metal surface and subsequently removed. Furthermore, if the metal article is a part of an assembly of moving parts requiring lubrication, the composition may be used subsequently as the lubricant for the assembly of parts once this is in an operating condition. Thus, as an example, gear box castings may be coated with the composition of the present invention to provide temporary protection against corrosion whilst the castings are being transported and subsequently the gear box may be assembled without having to remove the composition from the metal surfaces, the assembled gear box subsequently being used either with a composition in accordance with the present invention as the lubricant or with a different lubricant with which the composition of the present invention is compatible.

The composition of the present invention containing the anhydride provides a highly satisfactory protection against corrosion. However, a composition containing the liquid poly(oxyalkylene) glycol derivative and a hydroxy-oxime, in the absence of an anhydride, provides appreciably less protection against corrosion. A composition of the present invention containing both anhydride and hydroxy-oxime provides protection against corrosion which is at least as good as that provided by the anhydride alone even though a lower level of anhydride is present in the composition containing the mixture.

Various aspects of the present invention are set out in the following illustrative examples in which all parts and percentages are by weight unless otherwise stated and all concentrations are on a wt/wt basis.

EXAMPLE 1

Bright mild steel 1 inch×1 inch (25.4×25.4 mm) coupons having an average weight of 7.5 g were thoroughly washed with acetone followed by ethanol and stored in kerosene until required. Immediately prior to use, the coupons were washed with acetone.

Test coupons prepared as described previously were immersed for about two minutes in a 1% w/w solution, in a water insoluble poly(oxyalkylene) glycol having a viscosity of 460 cSt at 40° C. and available from Imperial Chemical Industries PLC as EMKAROX VG 462 lubricant base, of a 1:3 by weight mixture of 2-hydroxy-5-nonylbenzaldoxime with a long chain carboxylic acid anhydride. After immersion in the poly(oxyalkylene) glycol solution the steel coupons were subjected to a warm humid atmosphere (90% relative humidity at 40° C.). The coupons were inspected at regular intervals for evidence of the first onset of rust. For comparison steel coupons which had been subjected only to cleaning or which had been cleaned and immersed in the poly(oxyalkylene) glycol containing no additive, were also subjected to the warm humid atmosphere. The results are set out in Table One.

TABLE ONE

| Example or Comp. Ex. | Additive (a) | Time to Rust (days) |
|---|---|---|
| 1 | 1BAO + 3ASA | 21 |
| A | NIL | 4 |
| B | UT | 1 |

Notes to Table One
(a) BAO is 2-hydroxy-5-nonylbenzaldoxime
ASA is a 2:1 by weight mixture of 2-dodecenylsuccinic anhydride and 2-tetradecenylsuccinic anhydride.
NIL means the test coupons were immersed in the poly(oxyalkylene) glycol which contained no additive.
UT means that the test coupons were clean but had not been subjected to further treatment.

EXAMPLE 2

Test coupons cleaned as described in Example 1 were immersed, for two minutes, in a 1% w/w solution of an additive, in a water insoluble poly(oxyalkylene) glycol having a viscosity of 221 cSt at 40° C. and available from Imperial Chemical Industries PLC as 'EMKAROX' VG222 lubricant base.

The treated test coupons were transferred to distilled water maintained at 50° C. The coupons were inspected at regular intervals for evidence of rust. The results are set out in Table Two.

TABLE TWO

| Example or Comp. Ex. | Additive (a) (b) | Time to Rust (days) |
|---|---|---|
| C | AFA | 0.5 |
| 2 | 1BAO + 3ASA | 72 |
| D | NIL | 0.5 |

Notes to Table Two
(a) is as defined in Notes to Table One.
(b) AFA is a commercially available alkanolamine salt of a fatty acid.

EXAMPLE 3

The procedure of ASTM Test Method D 665A was carried out using a 0.5% w/w solution of the mixture used in Example 1 in a water soluble poly(oxyalkylene) glycol having a viscosity of 131 cSt at 40° C. and available from Imperial Chemical Industries PLC as 'EMKAROX' VG 132W lubricant base.

Pass or Fail was assessed in accordance with the test method. The results are set out in Table Three.

TABLE THREE

| Example or Comp. Ex. | Additive (a) | Result |
|---|---|---|
| 3 | 1BAO + 3 ASA | Pass |
| E | NIL | Fail |

Notes to Table Three
(a) is as defined in Notes to Table One.

EXAMPLES 4 to 7

The procedure of ASTM Test Method D 665B was carried out using a 3% w/w aqueous solution of sodium chloride and either a 0.25% w/w or a 1% w/w solution of an additive or additive mixture in the poly(oxyalkylene) glycol used in Example 2.

The metal specimens were weighed prior to and at the end of the test in order to determine weight loss. Pass or Fail was also assessed in accordance with the test method. The results are set out in Table Four.

TABLE FOUR

| Example or Comp Ex | Additive Type (a) | Additive Amount (%) | Wt loss (mg) | Pass or Fail |
|---|---|---|---|---|
| 4 | 1BAO + 3ASA | 1 | 0.2 | Pass |
| 5 | ASA | 1 | 0.4 | Pass |
| F | BAO | 1 | 20.7 | Fail |
| G | NIL | 0 | 25.0 | Fail |
| 6 | 1BAO + 3ASA | 0.25 | 0.7 | Fail |
| 7 | ASA | 0.25 | 1.8 | Fail |
| H | BAO | 0.25 | 24.2 | Fail |
| I | NIL | 0 | 25.0 | Fail |

Notes to Table Four
(a) is as defined in Notes to Table One.

EXAMPLE 8

A sample of a 1% w/w solution of an additive mixture in the poly(oxyalkylene) glycol used in Example 2 was placed in a beaker, weighed and then held in a forced draught oven at 180° C.

The beaker was removed at various time intervals, allowed to cool to room temperature, weighed and returned to the oven. Percentage weight losses were determined at three time intervals, and the results set out in Table Five.

These results indicate the enhanced anti-oxidation properties of the composition of the invention.

TABLE FIVE

| Example or Comp. Ex. | Additive (a) | Time (hours) 24 | 48 | 66 |
|---|---|---|---|---|
| J | Nil | 44 | 79 | 88 |
| 8 | IBAO + 3ASA | 35 | 62 | 76 |

Notes to Table Five
(a) is defined in notes to Table One.

EXAMPLE 9

Using a Mettler TA 4000 Differential Scanning Culcrimeter, runs were carried out using a 1% w/w solution of an additive mixture in the poly(oxyalkylene)-glycol used in Example 2.

The sample was weighed onto a small aluminium pan with a perforated lid and the temperature raised from 25° to 350° C. at 10° C./minute with an airflow rate of 80 ml/min. A plot was obtained depicting the relationship between any heat flow generated and the increasing temperature experienced by the sample.

The onset temperature of the exotherm was recorded and the results are set out in Table Six. The results illustrate an improvement in anti-oxidation.

TABLE SIX

| Example or Comp. Ex. | Additive (a) | Wt. of sample (mg) | Onset temperature of exotherm (°C.) |
|---|---|---|---|
| 9 | IBAO + 3ASA | 4.71 | 163 |

TABLE SIX-continued

| Example or Comp. Ex. | Additive (a) | Wt. of sample (mg) | Onset temperature of exotherm (°C.) |
|---|---|---|---|
| K | Nil | 4.48 | 153 |

Notes to Table Six
(a) is defined in Notes to Table One.

I claim:

1. A composition for protecting metals which comprises (a) a liquid poly(oxyalkylene) glycol derivative obtained by alkoxylation of a mono-, di- or polyhydroxy compound; and (b) A long chain anhydride selected from the group consisting of compounds having the following formula:

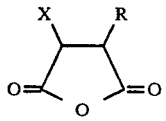

and a long chain phthalic anhydride in which said long chain substituent is defined as R;

wherein

R is a long chain hydrocarbyl radical containing at least 6 carbon atoms which is linear or branched, saturated or unsaturated, having a molecular weight of at least 100;

X is hydrogen, alkyl, aryl, alkoxy or aryloxy group; wherein component (b) is present from 0.01 to 30% by weight of the composition.

2. The composition of claim 1 wherein the poly(oxyalkylene) glycol derivative has a viscosity, measured at 40° C. using the procedure of ASTM Test Method D445, which is in the range of from 5 up to 500,000 cSt.

3. The composition of claim 1 wherein the poly(oxyalkylene) glycol derivative is a water-insoluble material based solely or predominantly on oxypropylene repeat units and which has a viscosity in the range from 10 up to 1200 cSt.

4. The composition of claim 1 wherein the poly(oxyalkylene) glycol derivative is a water-soluble material based solely or predominantly on oxyethylene repeat units and which has a viscosity in the range from 25 up to 250,000 cSt.

5. The composition of claim 1 wherein the anhydride is one in which X is hydrogen and R is nonyl, decyl, decenyl, dodecyl, dodecenyl, tetradecyl, tetradecenyl, hexadecyl, octadecyl or octadecenyl.

6. The composition of claim 1 wherein the anhydride is one in which R is an isobutylene polymer made from butene-1, butene-2 and isobutene and having a molecular weight from about 200 to 8000.

7. The composition of claim 1 which comprises a hydroxy-oxime of the general formula:

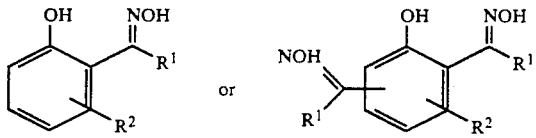

wherein $R^1$ is a hydrogen atom or an unsubstituted hydrocarbon group; and $R^2$ is an unsubstituted hydrocarbon group in which the hydrocarbon group contains from 5 to 22 carbon atoms, wherein the anhydride and hydroxy-oxime are present from 0.01 to 30% by weight of the composition and the weight ratio of anhydride, to the hydroxy-oxime is between 99:1 and 1:99.

8. The composition of claim 1 wherein the hydroxy-oxime is a mono-oxime which is a 2-hydroxy-5-alkylbenzaldoxime or a 2-hydroxy-5-alkylbenzoketoxime.

9. The composition of claim 8 wherein the hydroxy-oxime is 2-hydroxy-5-nonylbenzaldoxime.

10. The composition of claim 1 wherein the mono-, di or polyhydroxy compound is selected from the group consisting of methanol, ethanol, propanol, butanol, ethylene glycol, glycerol and pentaerythritol.

11. A process for protecting metals which comprises contacting a metal with a composition comprising (a) a liquid poly(oxyalkylene) glycol derivative obtained by alkoxylation of a mono-, di- or polyhydroxy compound; and (b) A long chain anhydride selected from the group consisting of compounds having the following formula:

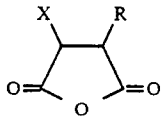

and a long chain phthalic anhydride in which said long chain substituent is defined as R;

wherein

R is a long chain hydrocarbyl radical containing at least 6 carbon atoms which is linear or branched, saturated or unsaturated, having a molecular weight of at least 100;

X is hydrogen, alkyl, aryl, alkoxy or aryloxy group; wherein component (b) is present from 0.01 to 30% by weight of the composition.

12. The process of claim 1 wherein the composition is applied to a metal surface to form a thin film of the composition on the metal surface.

13. A composition for protecting metals which comprises (a) a liquid poly(oxyalkylene) glycol derivative obtained by alkoxylation of a mono-, di- or polyhydroxy compound; and (b) A long chain anhydride selected from the group consisting of compounds having the following formula:

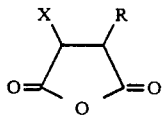

and a long chain phthalic anhydride in which said long chain substituent is defined as R;

wherein

R is a hydrocarbon chain having a molecular weight between 200 and 8000;

X is hydrogen, alkyl, aryl, alkoxy or aryloxy group; wherein component B is present from 0.01 to 30% by weight of the composition.

14. A composition for protecting metals which comprises (a) a liquid poly(oxyalkylene) glycol derivative obtained by alkoxylation of a mono-, di- or polyhydroxy compound; and (b) a phthalic anhydride wherein component (b) is present from 0.01 to 30% by weight of the composition.

15. A composition for protecting metals which comprises (a) a liquid poly(oxyalkylene) glycol derivative obtained by alkoxylation of a mono-, di- or polyhydroxy compound; and (b) A long chain anhydride selected from the group consisting of compounds having the following formula:

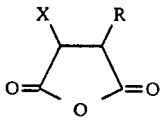

and a long chain phthalic anhydride in which said long chain substituent is defined as R;

wherein

R is a hydrocarbon chain having a molecular weight between 200 and 8000;

X is hydrogen, alkyl, aryl, alkoxy or aryloxy group; and (c) a hydroxy-oxime of general formula

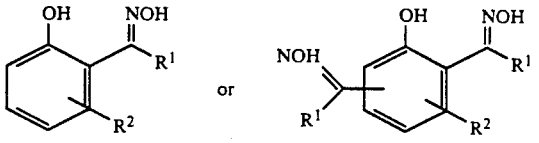

wherein $R^1$ is hydrogen or an unsubstituted hydrocarbon; and $R^2$ is an unsubstituted hydrocarbon group in which the hydrocarbon group contains from 5 to 22 carbon atoms wherein the anhydride and hydroxy-oxime are present from 0.01 to 30% by weight of the composition and the weight ratio of anhydride, to the hydroxy-oxime is between 99:1 and 1:99.

* * * * *